US009330585B2

(12) United States Patent
Eli

(10) Patent No.: US 9,330,585 B2
(45) Date of Patent: May 3, 2016

(54) DEVICE FOR DISPLAYING A VIDEO IMAGE ON A BUILDING

(75) Inventor: Gustavo Eli, Alfortville (FR)

(73) Assignee: CITILED, Paris (FR)

( * ) Notice: Subject to any disclaimer, the term of this patent is extended or adjusted under 35 U.S.C. 154(b) by 547 days.

(21) Appl. No.: 12/996,861

(22) PCT Filed: Jun. 8, 2009

(86) PCT No.: PCT/FR2009/051078

§ 371 (c)(1),
(2), (4) Date: Dec. 8, 2010

(87) PCT Pub. No.: WO2010/001026

PCT Pub. Date: Jan. 7, 2010

(65) Prior Publication Data

US 2011/0085321 A1 Apr. 14, 2011

(30) Foreign Application Priority Data

Jun. 9, 2008 (FR) ..... 08 53814

(51) Int. Cl.

| | |
|---|---|
| ***F21S 8/00*** | (2006.01) |
| ***F21S 4/00*** | (2006.01) |
| ***F21V 21/00*** | (2006.01) |
| ***G09F 19/22*** | (2006.01) |
| ***G09F 9/33*** | (2006.01) |

(52) U.S. Cl.
CPC *G09F 19/22* (2013.01); *G09F 9/33* (2013.01); *G09F 19/226* (2013.01)

(58) Field of Classification Search
CPC ..... G09F 19/22; G09F 19/226; G09F 9/33
USPC ..... 362/147
See application file for complete search history.

(56) References Cited

U.S. PATENT DOCUMENTS

| | | | | |
|---|---|---|---|---|
| 5,333,428 | A * | 8/1994 | Taylor et al. | 52/308 |
| 5,900,850 | A * | 5/1999 | Bailey et al. | 345/55 |
| 5,950,398 | A * | 9/1999 | Hubbard | 52/786.1 |
| 6,087,680 | A * | 7/2000 | Gramann et al. | 257/91 |
| 6,237,290 | B1 * | 5/2001 | Tokimoto et al. | 52/236.3 |
| 6,447,921 | B1 * | 9/2002 | Norimatsu et al. | 428/432 |
| 7,043,881 | B2 * | 5/2006 | Krause et al. | 52/171.3 |
| 7,745,838 | B2 * | 6/2010 | Lefevre | 257/88 |
| 7,817,327 | B2 * | 10/2010 | Derda | 359/275 |
| 8,044,415 | B2 * | 10/2011 | Messere et al. | 257/88 |
| 8,070,310 | B2 * | 12/2011 | Harwood | 362/147 |
| 8,283,680 | B2 * | 10/2012 | Repetto et al. | 257/88 |
| 2006/0239037 | A1 | 10/2006 | Repetto et al. | |
| 2007/0193140 | A1 * | 8/2007 | Carnick et al. | 52/208 |

(Continued)

FOREIGN PATENT DOCUMENTS

| | | | |
|---|---|---|---|
| DE | 102004039897 | A1 | 3/2006 |
| EP | 1715521 | A1 | 10/2006 |
| KR | 20050019473 | A | 3/2005 |

(Continued)

*Primary Examiner* — Donald Raleigh
(74) *Attorney, Agent, or Firm* — Jacox, Meckstroth & Jenkins

(57) ABSTRACT

The element, in particular for a building, comprises two panes facing each other and forming double glazing; and an electronic circuit including diodes and suitable for displaying at least a portion of a video image by means of the diodes, the circuit extending between the two panes, facing a visible zone of the panes.

The element may be used to form a video display device on a building facade.

12 Claims, 6 Drawing Sheets

(56) References Cited

U.S. PATENT DOCUMENTS

2009/0114928 A1* 5/2009 Messere et al. ..... 257/88
2010/0244732 A1* 9/2010 Kracht et al. ..... 315/294

FOREIGN PATENT DOCUMENTS

WO WO 2007045786 A1 * 4/2007 ..... B32B 17/10
WO WO 2007057459 A1 * 5/2007 ..... B32B 17/10

* cited by examiner

DEVICE FOR DISPLAYING A VIDEO IMAGE ON A BUILDING

CROSS-REFERENCE TO RELATED APPLICATIONS

This application is the U.S. National Phase application of PCT/FR2009/051078 filed Jun. 8, 2009, which claims priority to French Application No. 0853814 filed Jun. 9, 2008, which applications are incorporated herein by reference and made a part hereof.

BACKGROUND OF THE INVENTION

The invention relates to display panels using light-emitting diodes (LEDs) in particular panels of large dimensions extending over all or part of the facade of a building.

DESCRIPTION OF THE RELATED ART

It is known to form a video image display device on the facade of a building in which the display is delivered by means of light emitting diodes or LEDs. The device may be of very large dimensions, covering an area of up to several hundreds or even several thousands of square meters. Such a display presents advantages. Firstly it is incorporated in the architecture. Thus, it is the building that supports the display, the display taking advantage of the presence of the building to extend over a great height. The diodes consume relatively little energy. Nevertheless, they produce an image of marked contrast that is clearly visible even in broad daylight and in full sunlight. The diodes enable a film or a quick succession of images to be displayed with highly satisfactory rendering. Finally, and above all, the diodes and the electronic circuits carrying them can be placed on the facade of the building without closing off the facade for the occupants of the building. The diodes can be placed on supports that are widely spaced apart from one another, thereby conserving the major portion of the view for the occupants of the building and allowing as much natural light to enter as is desired.

Thus, it is common practice to place the circuit inside the building facing the windows that constitute the facade. The light emitted by the diodes is transmitted directly to the outside. The image created in this way is visible to people outside the building. In that configuration, the electronic circuit carrying the diodes is protected from bad weather and moisture in particular.

Nevertheless, that type of device presents certain drawbacks. The presence of the circuit facing the inside of the window makes it impossible to clean the window. Furthermore, a small fraction of the light emitted by the diodes is reflected on the window and is therefore perceived by the occupants of the building. This unwanted back-scattering is at best unattractive and at worse harmful or inconvenient for the occupants.

What is needed therefore is an improved device for displaying a video image that overcomes one or more of these problems.

SUMMARY OF THE INVENTION

An object of the invention is to improve diode display devices to facilitate cleaning the window and to eliminate the back-scattering effect.

For this purpose, one embodiment of the invention provides an element, in particular for a building, that comprises:

two panes facing each other and forming double glazing; and an electronic circuit including diodes and suitable for displaying at least a portion of a video image by means of the diodes, the circuit extending between the two panes, facing a visible zone of the panes.

Thus, the pane that is to be on the inside of the building is easily cleaned. In addition, the back-scattering effect that could occur by light being reflected on the inside face of the outside pane is greatly attenuated or even eliminated because of the presence of the inside pane. In addition, the back-scattering effect was particularly pronounced for the above-mentioned prior art display when the circuit was placed inside the building facing double glazing. With one embodiment of the invention, it is only one of the two panes that now faces the light emitted by the device, thereby also contributing to attenuating or eliminating this effect. Furthermore, these two advantages are obtained without putting the circuit into contact with bad weather. On the contrary, the circuit is fully protected against impacts and dirtying from outside and inside the building since it is received in the enclosure defined between the two panes. Above all, the invention does not in any way impede cleaning the outside panes since access to them for cleaning the facade remains completely unobstructed from outside the building.

Advantageously, facing the visible zone, the circuit consists in elongate units without connections between them in the visible zone.

This provides comfortable vision for the occupants of the building. The absence of any connection provides large viewing areas without a viewer's gaze meeting one of the elongate units.

Preferably, in the visible zone, the circuit is in contact with both of the panes.

The circuit is thus closely held in place and in position between the two panes. This serves in particular to avoid the circuit becoming deformed, e.g. sagging or warping as can happen with certain prior art devices under the effect of the temperature variations to which the circuit is subjected because of its operation and because of bad weather, and also because it is exposed to sunlight. This ensures that the dimensional characteristics of the device are constant.

Preferably, the circuit includes a semi-transparent support.

Advantageously, the circuit includes a support and, on a side opposite to the support, a layer of a protective material.

This layer protects the components of the circuit against becoming dirtied. It is also by means of this layer that the circuit can be brought to bear against one of the panes, the bearing surface thus being made uniform and of large area.

Preferably, an at least partial gas vacuum exists between the two panes.

Thus, by establishing an at least partial vacuum, any risk of the electronic circuit becoming spoilt by dirtying or by dust is further reduced and its lifetime is increased.

Preferably, the circuit includes at least one connector that does not extend facing a visible zone of the panes and that interconnects portions of the circuit that do extend facing the visible zone.

The connector is thus offset into a portion of the element that is hidden from sight. For example this might be an upright of a window if the element constitutes a window. This characteristic further improves architectural incorporation of the device within the building.

Advantageously, the element includes a control module for the circuit, which module is accessible from outside the element.

The invention also provides a display device comprising a plurality of elements of the invention.

The invention also provides a building wall that includes at least one display device of the invention.

Finally, the invention also provides a building including at least one wall of the invention.

The invention also provides a method of fabricating an element, in particular for a building, wherein two panes and an electronic circuit including diodes suitable for displaying at least a portion of a video image by means of the diodes are placed in such a manner that the panes extend facing each other so as to form double glazing, and the circuit extends between the two panes and facing a visible zone of the panes.

The method of the invention may present any one of the following characteristics:

each of the panes bears against the circuit;

an at least partial gas vacuum is established between the two panes; and portions of the circuit are connected together by means of at least one connector and the connector is placed in such a manner that it does not extend facing the visible zone.

Other characteristics and advantages of the invention appear further from the following description of a preferred embodiment given by way of non-limiting example and with reference to the accompanying drawings, in which:

BRIEF DESCRIPTION OF THE ACCOMPANYING DRAWINGS

DETAILED DESCRIPTION OF INVENTION

Figure 1:
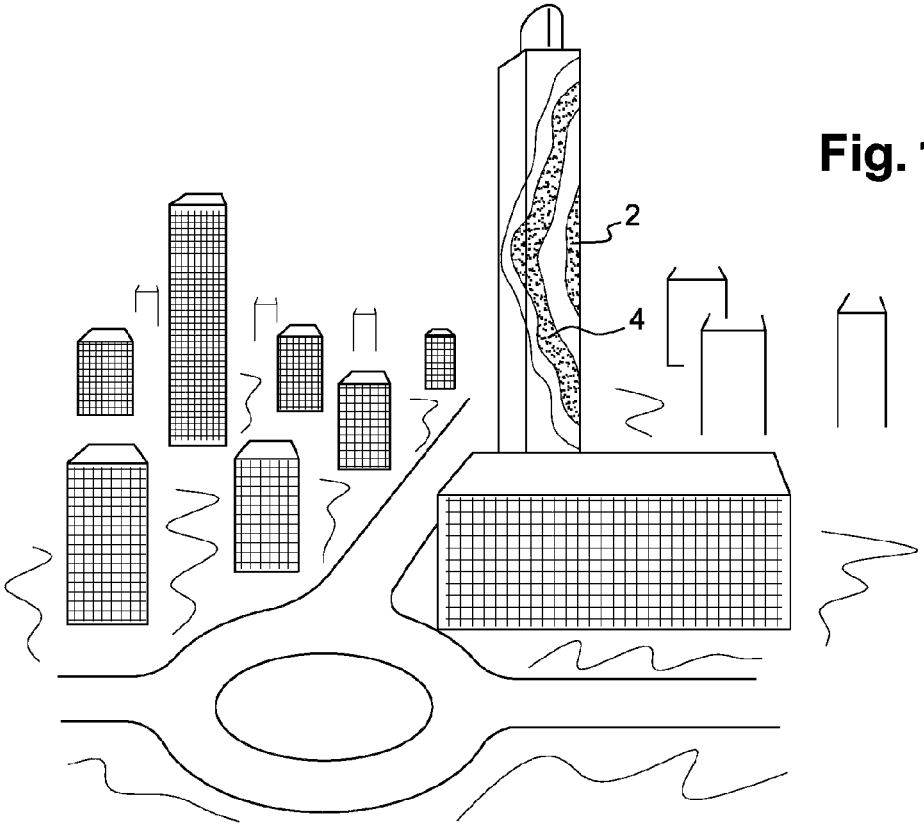
FIG. 1 is a perspective view of a building in its environment, the facade of the building including a display device constituting a preferred embodiment of the invention.

The building 2 shown in FIG. 1 presents a plurality of facades on its respective sides, there being four of them in this example. One of them, the facade 4, is a facade of one embodiment of the invention insofar as it includes a video image display device. This device 6 is visible in particular in FIGS. 2, 3, and 5.

The facade 4 comprises a plurality of building elements, here formed by windows 8. These windows 8 extend from top to bottom along the height of the facade 4 of the building and from one side to the other along its width. The windows are in line with one another in both directions, and by way of example most of them are in the same plane, and indeed all of them may be in the same plane if the facade is plane. Each window 8 has two panes 10, 12, as can be seen in particular in FIG. 3. The term "pane" is used herein to mean a transparent panel made of glass. However, such a pane could be made of some material other than glass, for example it could be made of synthetic material or of plastics material.

Figure 5:
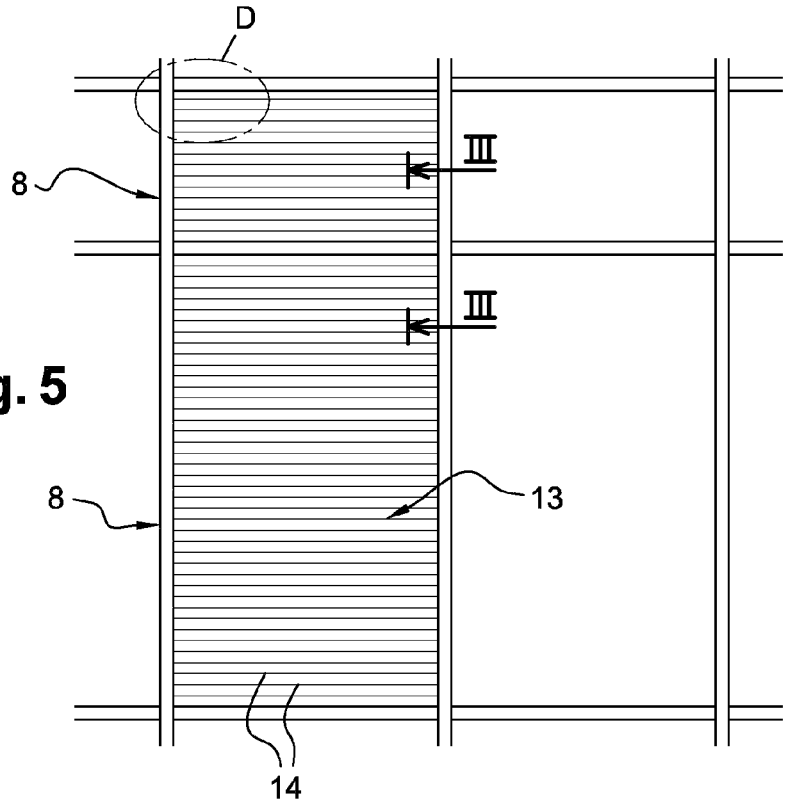
FIG. 5 is an elevation view of a portion of the facade of the FIG. 1 building.

The two panes 10 and 12 are plane and identical to each other. Each of them extends in a vertical plane facing the other, parallel thereto, and spaced apart therefrom. Their outlines are superposed. Here the panes are rectangular in shape, as shown in FIG. 5. In this figure, it can be seen that the facade may present windows 8 of at least two types having, in particular, different dimensions. Thus, in the present example, the facade is made up geometrically by reproducing a rectangular mesh comprising in its top portion a window of small height, and in its bottom portion a window of considerable height. The two windows of the mesh have the same width, which is about 2 meters (m) or 6.56 feet in this example. The height of the small window is specifically 1.05 m or 3.44 feet, while the other height of the tall window is specifically 3.05 m or 10.01 feet. The total height of the mesh is 4.10 m or 13.45 feet in this example. These dimensions are given merely by way of example and they are not limiting.

Figure 2:
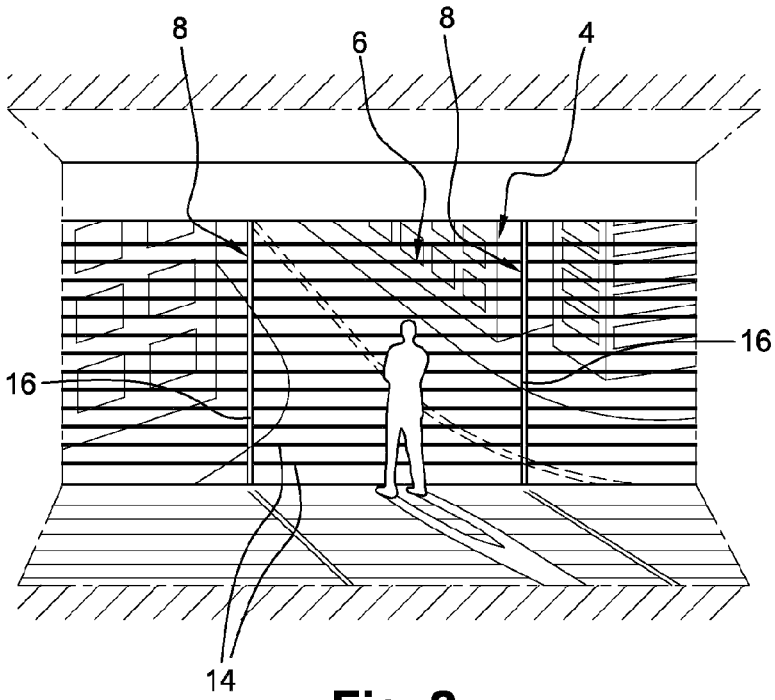
FIG. 2 is a view showing a portion of said facade as seen from inside the FIG. 1 building.
Figure 4:
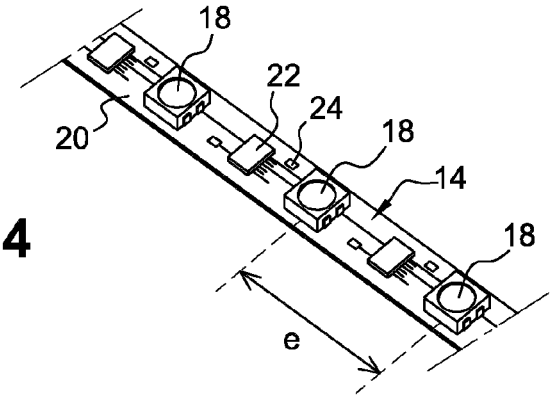
FIG. 4 is a fragmentary perspective view of the electronic circuit of the FIG. 3 facade.
Figure 6:
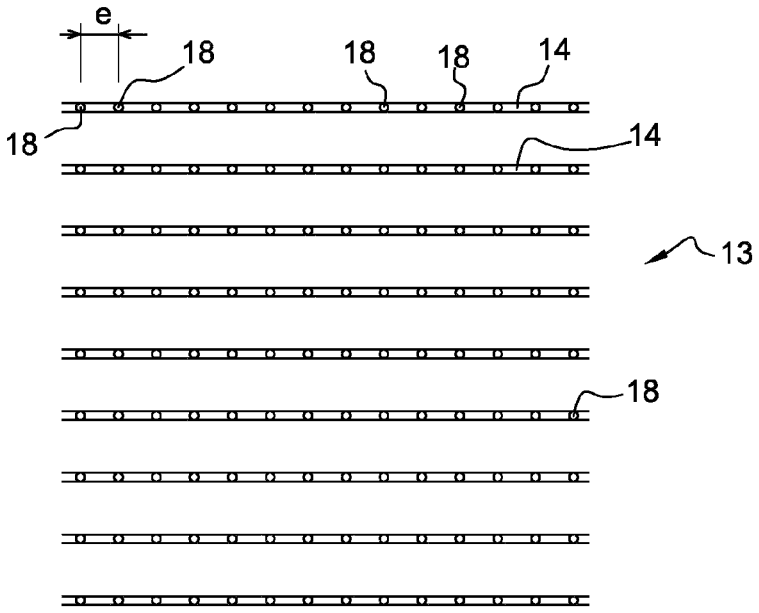
FIG. 6 is a view on a larger scale of a detail D in FIG. 5, showing how the diodes are arranged.

Between the two panes 10 and 12 of each window 8 there extends an electronic circuit 13 (FIG. 6) having units such as the unit 14 shown in part in FIG. 4. In the present example, these units 14 are in the form of mutually identical elongate straight bars. The bars 14 are here arranged horizontally in a common vertical plane, all being parallel to one another and spaced apart from one another. It should be observed that the bars, as can be seen in the visible zone of the window as shown in FIG. 2 (i.e. facing the visible portion of the panes) have no mechanical or electrical or electronic connections occupying this visible zone. As explained below, the electronic circuit 13 associated with each window 8 includes a member that interconnects the bars 14 and that is received in a portion of the window that is hidden from view. For each consecutive pair of bars 14 in the succession, the space defined between the two bars is thus left entirely empty. It is defined at its ends solely by the uprights 16 of the window.

Each bar 14 comprises identical diodes 18 that are regularly spaced apart from one another. In the present example, the pitch e, shown in FIGS. 4 and 6, i.e., the distance between the axes of successive diodes, is 5 centimeters (cm) or 1.97 inches (in). This spacing is preferably selected so as to be large compared with the dimensions of the diodes themselves. Thus, if the diameter of each diode is less than 1 cm or 0.39 inch, it can be seen that the pitch is equal to five times the diameter of the diode. The value for the pitch can be selected freely as a function of circumstances (in particular as a function of the orientation of the facade relative to the sun), it being understood that the closer the diodes are to one another, the greater the brightness of the device.

The bar 14 comprises a substrate or support 20 to which the panels are fastened. In the present example, the support 20 is semi-transparent. Each bar 14 also carries electronic components 22, 24, that are themselves known and that serve to display the image by means of the diodes 18. As can be seen in particular in FIGS. 5 and 6, the diodes thus form an array of pixels, each constituting one of the elements of the image to be displayed. The diodes are LEDs which are preferably of the surface-mounting dot (SMD) type. Each diode is surmounted by a primary optical member 26 of the lens type serving to direct the light emitted by the diode towards privileged zones for viewing the screen. Specifically, the idea is to send the light in directions away from the building and also to avoid sending the light towards the sky.

The circuit 13, and indeed each bar 14, is suitable for causing the portion of the image to be displayed by means of the diodes 18. It is suitable for controlling diodes, diode by diode, i.e., it is suitable for controlling each diode independently of all the others, in particular for the purpose of displaying successive different images using the same diodes.

Figure 9A:
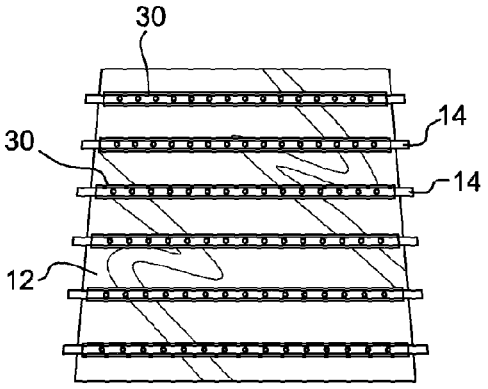
Figure 9B:
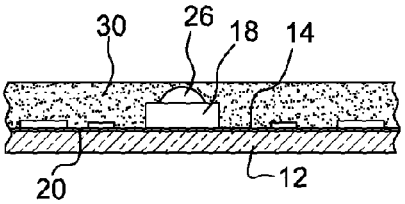

As can be seen in particular in FIG. 9*b*, the circuit 13 incorporates a layer 30 of transparent material, specifically flexible silicone. This protective layer extends from the side of the circuit that is remote from the support 20. It therefore extends from the outside relative to the position of the circuit when it is in position on the facade.

The steps of fabricating the element 8 and of putting it into place on the building in order to make up the facade are described below.

Figure 7:
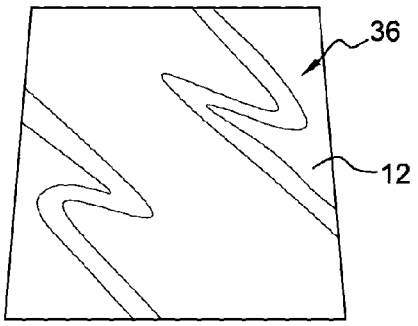
FIGS. 7 to 14 show respective steps in the method of the invention for fabricating an element of the facade of the FIG. 1 building and for installing the elements on the building.

With reference to FIG. 7, the pane 12 is placed in a horizontal position.

Figure 8A:
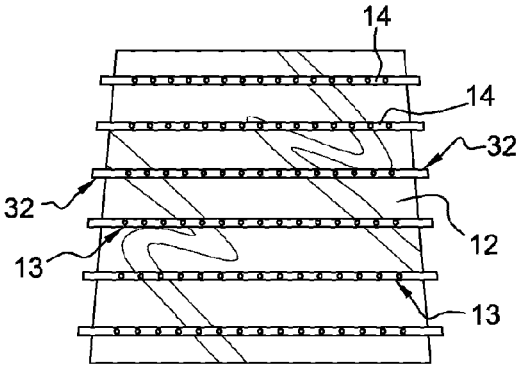
Figure 8B:
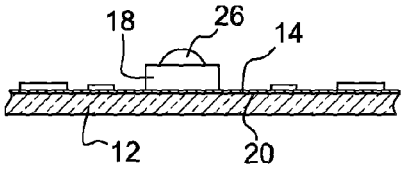

With reference to Figures FIGS. 8*a* and 8*b*, the bars 14 are installed on the pane 12 with the supports 20 thereof in contact with and bearing against the pane 12. The diodes 18 extend on the side of the support 20 opposite to the pane 12. The bars 14 are installed in the position they are to occupy on the pane. Thus, the bars 14 extend parallel to one another and they are spaced apart from one another. Each bar 14 presents two longitudinal ends 32 that project beyond the corresponding edges of the pane 12.

With reference to FIGS. 9*a* and 9*b*, a flexible protective layer 30 is put into place on each of the bars 14.

Figure 10:
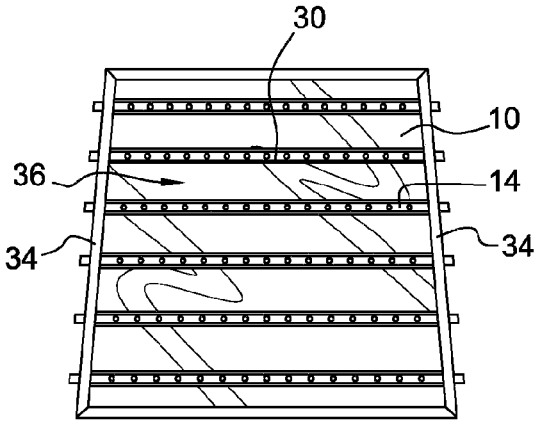

With reference to FIG. 10, the weather-strips or gaskets 34 of the double glazing are put into place on the assembly. These gaskets form a continuous outline covering the rectangular perimeter of the pane 12 and thus its four sides. The gasket extends over the inside face 36 of the pane that receives the circuit 13. The gasket also covers the bars 14 over which it passes.

Figure 11A:
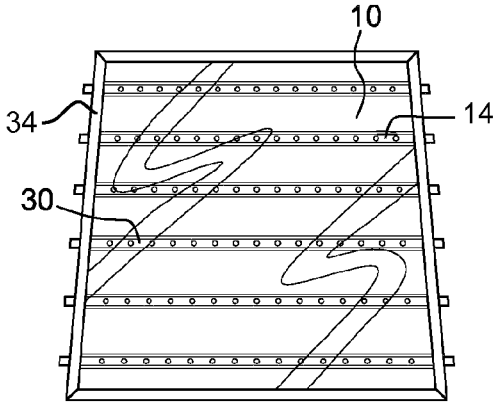
Figure 11B:
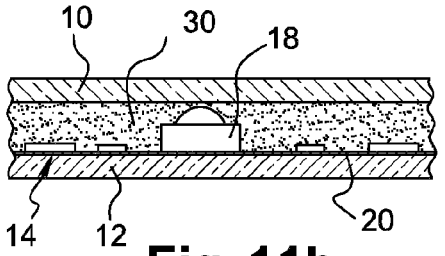

With reference to FIGS. 11*a* and 11*b*, the second pane 10 is then installed on the assembly. The top pane 10 comes to bear against the gasket 34 and against the layers 30 on the bars 14. It thus closes the space defined between the two panes and between each pair of bars. This closure is achieved by sealing relative to the above-mentioned gasket 34 and the layers 30. The components of the window are naturally firmly fastened to one another in appropriate manner. In this position, and as can be seen in FIG. 11*b*, the support 20 of the bars 14 makes contact over a surface area with the outside face of the bottom or internal pane 12. Simultaneously, the protective layer 30 makes surface area contact via its outside face with the inside face of the top or outside pane 10. Each bar 14 is thus sandwiched and held firmly between the two panes 10 and 12.

Thereafter, a partial or total vacuum is established in the space defined between the two panes and occupied by the major fraction of each bar. This vacuum, i.e. this reduction in the pressure of the gas within the enclosure to below atmospheric pressure, is achieved by a technique that is itself conventional and is not described herein.

Figure 12:
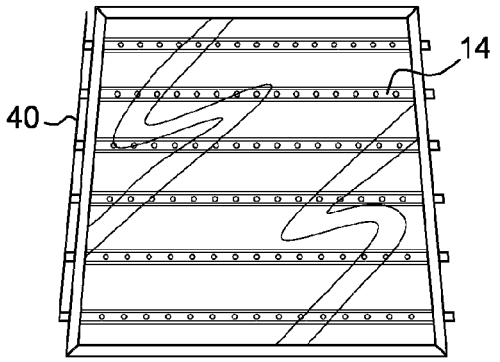

With reference to FIG. 12, a connector 40 is put into place interconnecting the ends 32 that are situated on the same side of the window, here the left side. All of the bars 14 of the window are thus connected to a common connector 40. This connection enables them to be powered electrically and controlled to display the video image. The connector does not extend over the visible zone of the panes.

Figure 13:
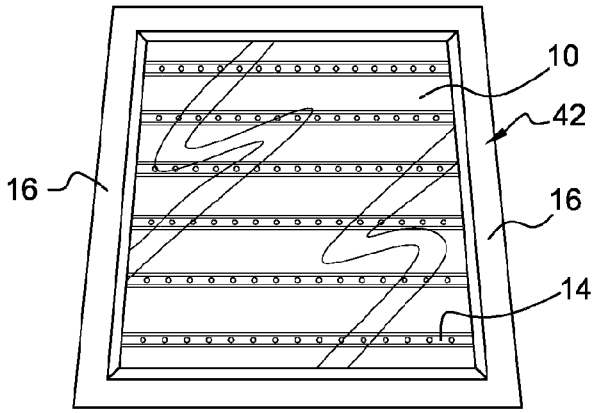

With reference to FIG. 13, the edge zone of the resulting stack is then covered by a frame 42, here of rectangular shape, overlying the stack on the outside corresponding to the pane 10, on the inside corresponding to the pane 12, and on each of the edge faces of the stack. This frame thus constitutes in particular the left and right uprights 16 of the window. The connector 40 is thus hidden by sight by being housed in the left upright.

Figure 3:
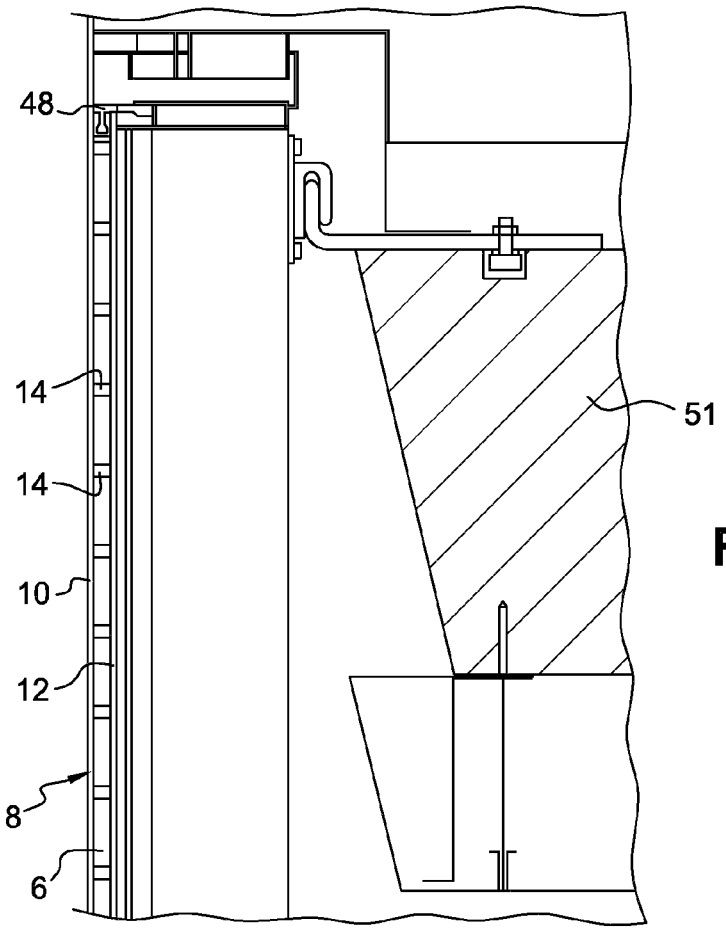
FIG. 3 is a fragmentary vertical section view taken along the line III-III in FIG. 5 of the facade of the FIG. 1 building.
Figure 14:
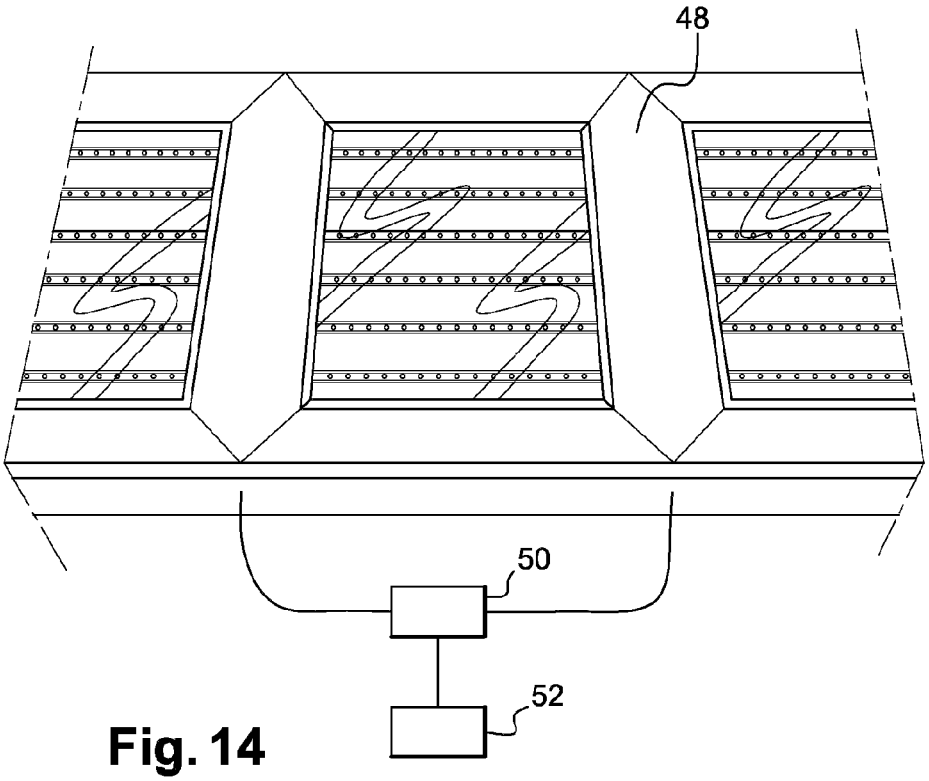

The window can then be mounted in its casing 48. This mounting may be performed prior to placing the assembly on the facade, or else, if the casing 48 is already installed on the facade, directly on the facade as shown in FIG. 14. The window then occupies its position. As shown in FIG. 3, the window with its casing 48 is carried by the structure of the building, and in particular its beams, floors 51, etc., and is connected to said structure in appropriate manner.

Once the facade has been made, the electronic circuits 13 of the various windows 8 are connected to a central control member 52 that causes the device to display desired content: a stationary image, a moving image, text, etc.

Provision is preferably also made for each window 8 to have an intermediate control member such as a control card 50 that enables a fraction of the image for display to be controlled pixel 18 by pixel 18 for the window. These control cards 50 are themselves controlled by the central control member 52 in order to display the image as a whole. Preferably, the control card 50 is accessible from outside the window (relative to the window) and from inside the building or from outside the building for maintenance purposes.

Such a display device forms a screen of very large size and it can operate on the basis of a video signal of various types, e.g. delivered by a computer or a video player. The video signal may be in analog or digital format. The device may present images in color. Each diode may take on a plurality of colors at will. Depending on the dimensions of the building and of the facade, it is possible to give the screen the desired dimensions. The screen may cover the entire facade, or on the contrary only a portion thereof. The spacing between the diodes makes it possible to define the resolution of the display device and also the level of transparency desired to enable the occupants of the building to see the outside. Similarly, the dimensioning of the bars 14 and their mutual spacing can be selected so as to give the desired level of luminosity inside the building by allowing daylight and sunlight to enter. From inside the building, the display device with its bars 14 has exactly the same appearance as a venetian blind.

The silicone protective layer 30 is thermally neutral. It enables the circuit it covers to be made waterproof and airproof.

Provision can be made for the distance between the two panes 10 and 12 to lie in the range 6 millimeters (mm) or 0.24 inch to 20 mm or 0.79 inch, for example it may be 12 mm or 0.47 inch.

Naturally, numerous modifications can be made to the invention without going beyond the ambit thereof.

The base element 8 for constituting the display device may be a window, a window door, or a show window. It could also be a roofing element. It need not be a window.

It is possible to envisage using the invention independently of the presence of a building, in the form of a display device comprising the two panes.

The number of panes is not restricted to two, so it is possible to use the invention in the presence of triple glazing, the third pane either being on the outside or on the inside of the device.

The invention is applicable to buildings erected on the ground, and also to movable vehicles and craft.

The wall may be an outside facade, or an inside wall or facade, e.g. facing a patio.

While the forms of apparatus herein described constitutes preferred embodiments of this invention, it is to be understood that the invention is not limited to these precise forms of apparatus, and that changes may be made therein without departing from the scope of the invention which is defined in the appended claims

What is claimed is:

1. An element, in particular for a building, the element comprising:

two panes facing each other and forming double glazing; and an electronic circuit suitable for displaying at least a portion of a video image by means of diodes and including units in the form of elongated bars arranged parallel to one another in a common plane and spaced apart from one another, each unit extending substantially between said two panes and comprising a support carrying said diodes on one of its sides that are spaced apart from one another along said elongated bars, said elongated bars being arranged such that a side of said elongated bars is in contact with and bearing against one of said two panes while a second side of said elongated bars is in contact with a surface of the other of said two panes;

wherein said elongated bars are arranged without any connection between them in a visible zone of said double glazing;

wherein said diodes are arranged on said elongated bars so that when said electronic circuit energizes said diodes, said at least a portion of said video image is displayed through at least one of said two panes and away from the building on which said two panes are mounted.

2. The element according to claim 1, wherein said support of said elongated bar is a semi-transparent support.

3. The element according to claim 1, wherein said elongated bar includes a layer of a protective material arranged on its side opposite to said support.

4. The element according to claim 1, wherein said electronic circuit includes at least one connector that does not extend facing a visible zone of said two panes and that interconnects the various elongated bars that do extend facing said visible zone.

5. The element according to claim 1, including a control module for said electronic circuit, which said control module is accessible from outside the element.

6. A display device comprising a plurality of elements according to claim 1.

7. A wall of a building, in particular a facade, comprising at least one display device according to the claim 6.

8. A building comprising at least one wall according to claim 7.

9. A method of fabricating an element, in particular for a building, the method comprising the step of:

placing two panes and an electronic circuit including units in the form of elongated bars arranged parallel to one another, each unit including diodes and being suitable for displaying at least a portion of a video image by means of said diodes in such a manner that said two panes extend facing each other so as to form double glazing, and causing said elongated bars of said electronic circuit, which extends substantially between said two panes, to face a visible zone of said two panes;

wherein said elongated bars are arranged without any connection between them in said visible zone of said double glazing;

wherein said diodes are arranged on said elongated bars so that when said electronic circuit energizes said diodes, said at least a portion of said video image is displayed through at least one of said two panes and away from the building on which said two panes are mounted.

10. The method according to claim 9, wherein each of said two panes bears against said elongated bars of said electronic circuit.

11. The method according to claim 9, wherein said elongated bars of said electronic circuit are connected together by means of at least one connector and said at least one connector is placed in such a manner that it does not extend facing said visible zone.

12. The element according to claim 1, wherein an at least partial gas vacuum exists between said two panes.

* * * * *